US009445968B1

(12) United States Patent
Burstein

(10) Patent No.: US 9,445,968 B1
(45) Date of Patent: Sep. 20, 2016

(54) INFANT MOBILITY DEVICE

(71) Applicant: Amir Burstein, San Luis Obispo, CA (US)

(72) Inventor: Amir Burstein, San Luis Obispo, CA (US)

( * ) Notice: Subject to any disclaimer, the term of this patent is extended or adjusted under 35 U.S.C. 154(b) by 0 days.

(21) Appl. No.: 14/757,121

(22) Filed: Nov. 20, 2015

Related U.S. Application Data

(60) Provisional application No. 62/123,615, filed on Nov. 21, 2014.

(51) Int. Cl.
*A61H 99/00* (2006.01)

(52) U.S. Cl.
CPC ..... *A61H 99/00* (2013.01); *A61H 2201/0173* (2013.01); *A61H 2201/1253* (2013.01); *A61H 2201/1652* (2013.01)

(58) Field of Classification Search
CPC ..... A61H 2201/0173; A61H 2201/1652; A61H 99/00
USPC ..... 280/1.5
See application file for complete search history.

(56) References Cited

U.S. PATENT DOCUMENTS

| | | | | | |
|---|---|---|---|---|---|
| 2,592,696 | A | | 4/1952 | Hoody | |
| 2,815,909 | A | | 12/1957 | Paprocki | |
| 3,532,356 | A | * | 10/1970 | Lillibridge | A47D 13/04 248/431 |
| 3,778,052 | A | | 12/1973 | Andow et al. | |
| 3,901,165 | A | | 8/1975 | Schlesinger | |
| 3,992,023 | A | * | 11/1976 | Moorer | A61G 5/00 280/87.021 |
| 4,347,914 | A | | 9/1982 | Gary | |
| 4,569,532 | A | * | 2/1986 | Mirkarimi | B62B 7/00 280/32.5 |
| 4,679,260 | A | | 7/1987 | Frettem | |
| 4,796,903 | A | * | 1/1989 | Proctor | A61H 3/04 280/32.5 |
| 5,322,409 | A | * | 6/1994 | McCluney | A01D 46/243 280/32.5 |
| 6,019,705 | A | * | 2/2000 | Thom | A47D 13/04 482/51 |
| 6,056,274 | A | | 5/2000 | Naas et al. | |
| 6,170,840 | B1 | | 1/2001 | Mathias | |
| 6,367,582 | B1 | | 4/2002 | Derby | |
| 6,578,594 | B1 | * | 6/2003 | Bowen | A61H 3/008 135/67 |
| 6,890,288 | B2 | | 5/2005 | Bingham | |
| 6,929,478 | B1 | * | 8/2005 | Spencer | A63B 7/02 434/247 |
| 7,121,989 | B2 | | 10/2006 | Kerry | |
| 7,178,632 | B2 | | 2/2007 | Casebolt et al. | |
| 7,494,450 | B2 | * | 2/2009 | Solomon | A61H 1/0229 482/51 |
| 7,780,587 | B2 | * | 8/2010 | Thornton | A61H 3/008 119/770 |
| 7,900,940 | B1 | * | 3/2011 | Vidmar | A61H 3/008 280/271 |
| 8,267,838 | B2 | | 9/2012 | Rasmussen | |
| 2004/0063550 | A1 | | 4/2004 | Harris | |
| 2004/0214696 | A1 | | 10/2004 | Kerry | |
| 2006/0157298 | A1 | | 7/2006 | Beggrow | |
| 2008/0000719 | A1 | | 1/2008 | Jones | |
| 2008/0276880 | A1 | | 11/2008 | Swisher et al. | |
| 2011/0239898 | A1 | | 10/2011 | Brown | |

* cited by examiner

*Primary Examiner* — Anne Marie Boehler
*Assistant Examiner* — Michael Stabley
(74) *Attorney, Agent, or Firm* — Lorimer Labs; D'Arcy H. Lorimer

(57) ABSTRACT

A system for aiding the crawling mobility of children or young adults is disclosed. The system consists of central hub supported by four legs. The patient is enclosed in a harness which is coupled to a support cord extending through the central hub. A lifting force partially offsetting the patient's weight is supplied by tension on the support cord, which is locked relative to the central hub via a locking device. Coupling between the support cord and harness is provided by carabineers which are clipped to "D" rings on the harness. The balance point can be adjusted by moving the attachment point to various "D" ring locations.

8 Claims, 14 Drawing Sheets

INFANT MOBILITY DEVICE

REFERENCES TO PRIOR APPLICATIONS

This application is related to provisional application, reference no. 62/123,615 filed Nov. 21, 2014, entitled INFANT MOBILITY DEVICE, and claims benefit thereof. Provisional application no. 62/123,615 is hereby incorporated by reference in its entirety.

BACKGROUND OF THE INVENTION

The invention relates to the design and structure mobility aid devices. More specifically, the invention relates to devices to aid infants and young children develop crawling motor skills and strength.

Some infants and young children are born with, or have obtained though disease or injury, disabilities which have slowed their early crawling or mobility skills. These patients may require support devices to aid in teaching and developing the motor skills needed for crawling.

The prior art discloses many devices suitable for the support of the human body for various activities, from lifting during rescue operations by firefighters to support for exercise and physical rehabilitation. None of these devices, however, are suitable for use with infants where the primary goal is to teach crawling skills. For this application, the device must be light weight, support the body weight of the infant in the correct manner, and be mobile with respect to the support surfaces to allow motion from one location to another. Further, it would be advantageous for the device to be easily disassembled or broken down for shipping or transport, and be easily adjusted to fit children or young adults of varying body types and sizes.

Such devices, although primarily designed for human occupation, may also be applied to use by animals, particularly those who have lost limbs or whose limbs are damaged. The device may be used on a temporary basis to aid healing and develop strength in damaged limbs, or on a more permanent basis for animals who have lost use of one or more limbs.

These and other limitations of the prior art will become apparent to those of skill in the art upon a reading of the following descriptions and a study of the several figures of the drawing.

SUMMARY OF THE INVENTION

It is an object of the present invention to provide a system for aiding the crawling mobility of a human or animal occupant by providing a lifting force for the occupant while the occupant is crawling over a surface, containing a first support leg having a first end and a second end, the second end having a first caster attached thereto; a second support leg having a first end and a second end, the second end having a second caster attached thereto; a third support leg having a first end and a second end, the second end having a third caster attached thereto; a fourth support leg having a first end and a second end, the second end having a fourth caster attached thereto; a hub having a first cavity, a second cavity, a third cavity, and a fourth cavity fashioned therein, the first end of the first support leg being inserted within the first cavity of the hub, the first end of the second support leg being inserted within the second cavity of the hub, the first end of the third support leg being inserted within the third cavity of the hub, the first end of the fourth support leg being inserted within the fourth cavity of the hub, the first through the fourth support legs being oriented with respect to the hub in a manner such that the first through the fourth casters are in contact with the surface; a support cable extending through a center of the hub having an attachment end portion situated below the hub; a harness device extending around at least a portion of the occupant having a plurality of attachment devices mounted thereto, the plurality of attachment devices aligned in a linear array along a spine of the occupant; a coupling device operative to connect the attachment end portion of the support cable to one or more of the attachment devices mounted on the harness device; wherein a point of attachment of the coupling device to one or more plurality of attachment devices within the linear array along the spine of the occupant alters a balance point of the lifting force, while the support cable is under tension and while the support cable is free of tension.

These and other embodiments, features and advantages will become apparent to those of skill in the art upon a reading of the following descriptions and a study of the several figures of the drawing.

BRIEF DESCRIPTION OF THE DRAWINGS

Several example embodiments will now be described with reference to the drawings, wherein like components are provided with like reference numerals. The example embodiments are intended to illustrate, but not to limit, the invention. The drawings include the following figures.

DETAILED DESCRIPTION OF THE PREFERRED EMBODIMENTS

Figure 1:
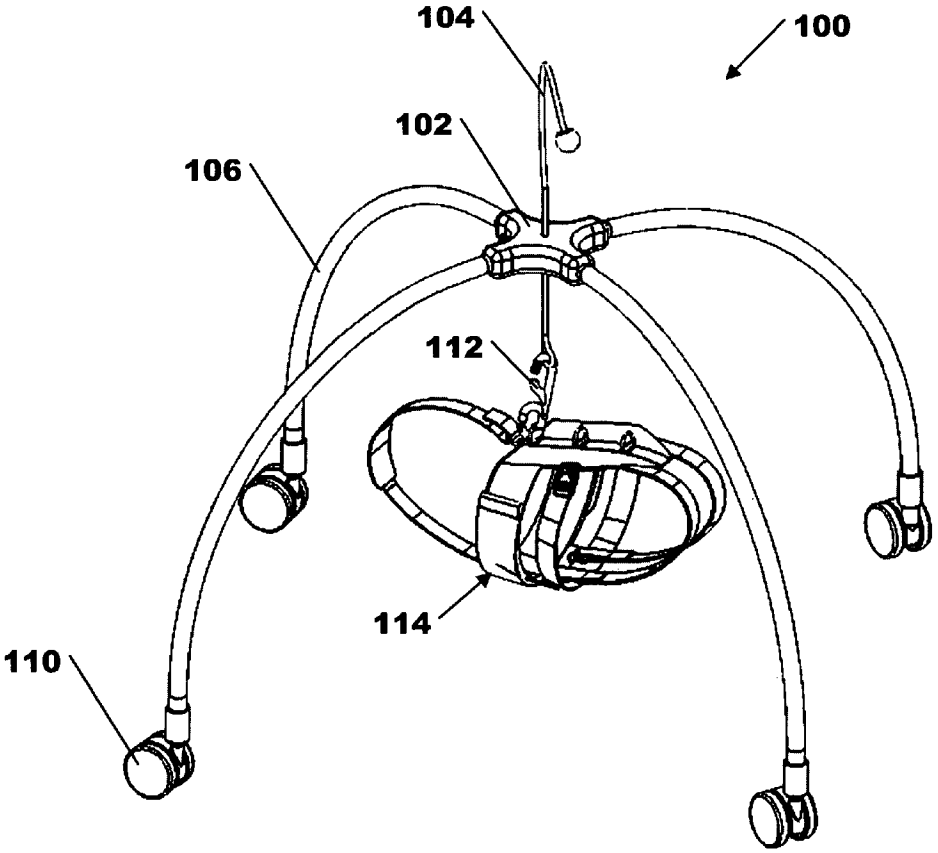
FIG. 1 is a perspective view of a mobility device, in accordance with an example embodiment of the present invention.

The present invention discloses devices for aiding the crawling mobility of young children or infants. Optionally, the devices heretofore described may also be applied to adult humans as well as animals. In the following descriptions of the example embodiments of the present invention, the word "patient" is used to describe an occupant supported by the device, and is not meant to limit the device application to only human beings, or specifically human children or infants.

In one example embodiment, the devices comprise a central hub, support legs attached to the hub, casters or rollers attached to the support legs, a support cable extending through the central hub, a harness to support the body of the patient in a horizontal position attached to the support cable, and a locking device to fix the position (or adjust the tension) of the support cable relative to the hub. The support legs are inserted into cavities within the hub and are held in place with retaining springs. The support legs are easily removed from the hub for shipping or storage. Optionally, the support legs can be adjusted for length to change the relative position of the hub above the support surface. The support device of the present invention can apply a varying supporting force by adjusting the tension or length of the support cable. Varying the support force is often required to adjust mobility parameters or encourage muscle development in the patient.

In the afore referenced example embodiment, the harness comprises two main sections, an upper section and a lower section. The upper section surrounds and supports the upper body (chest and shoulders) and extends down to the waist. The upper section has straps that extend over the shoulders and "D" rings mounted in bosses that extend down the back or spine of the patient mounted in the harness. The lower section extends around the waist and attaches to both the shoulder straps and the waist portions of the upper section. The lower section contains a crotch strap that couples with a D ring on the lower spine section of the upper harness. The upper and lower harness sections are coupled together at the waist with hook and loop fasteners.

In the afore referenced example embodiment, once mounted within the harness, the patient is supported under the mobility device by a cable that extends through the hub and attaches to the "D" rings mounted on the back or spine portion of the harness. The height of the patient above the crawling surface can be adjusted by the length of cable between the harness "D" rings and the hub. The cable is adjusted by releasing the locking device through which the cable extends. Engaging the locking device fixes the cable length relative to the hub. There are a plurality of "D" rings mounted in various positions (in the upper harness) along the spine of the patient. These serve to shift the support point or balance point along the patient's back, in order to shift weight from the arms/hands to the feet/legs or vise versa. Discreet "D" rings are used to avoid any shift in the balance point while the patient is crawling.

A carabineer or similar device is used to couple the end of the support cable to "D" rings on the harness. In one variation of the example embodiment, a single carabineer is used. In a second variation of the example embodiment, two carabineers are utilized. Two carabineers allow the balance point to be changed while the support cable is under tension from the weight of the patient.

The flexible cable along with the freely rotating casters mounted in the legs of the mobility device allow complete 360 degree freedom of movement of the patient on the crawling surface.

FIG. 1 is a perspective view of a mobility device 100, in accordance with an example embodiment of the present invention. The mobility device 100 comprises a hub 102, support legs 106, support cable 104, casters 110, harness attachment device 112, and patient support harness 114.

Figure 2:
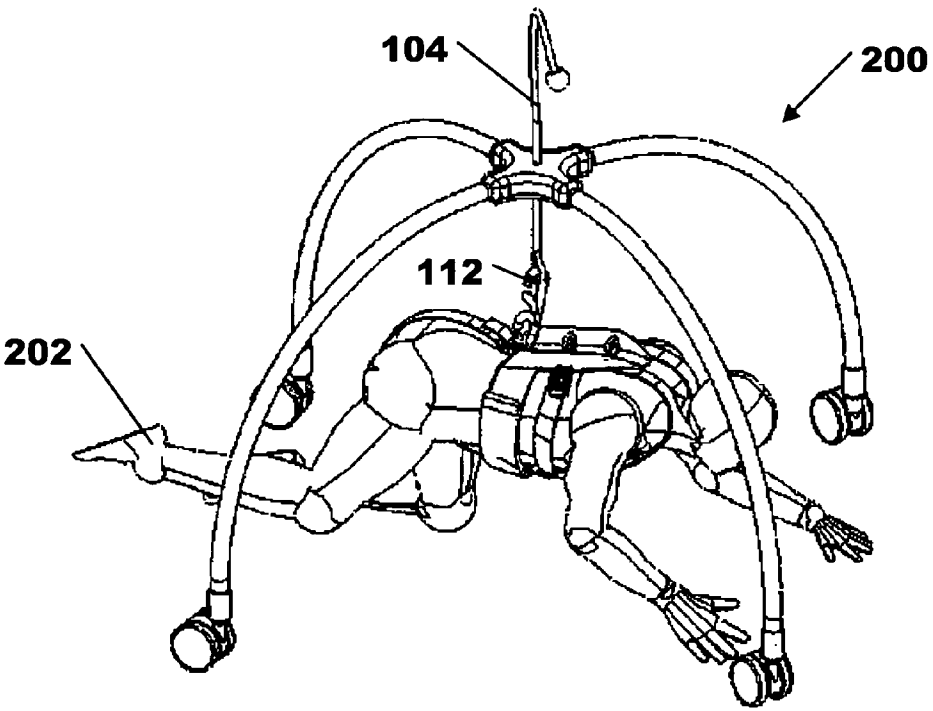
FIG. 2 is a perspective view of a mobility device with a human occupant, in accordance with an example embodiment of the present invention.

FIG. 2 is a perspective view 200 of a mobility device 100 with a human occupant 202, in accordance with an example embodiment of the present invention.

Figures 3A, 3B, 3C:
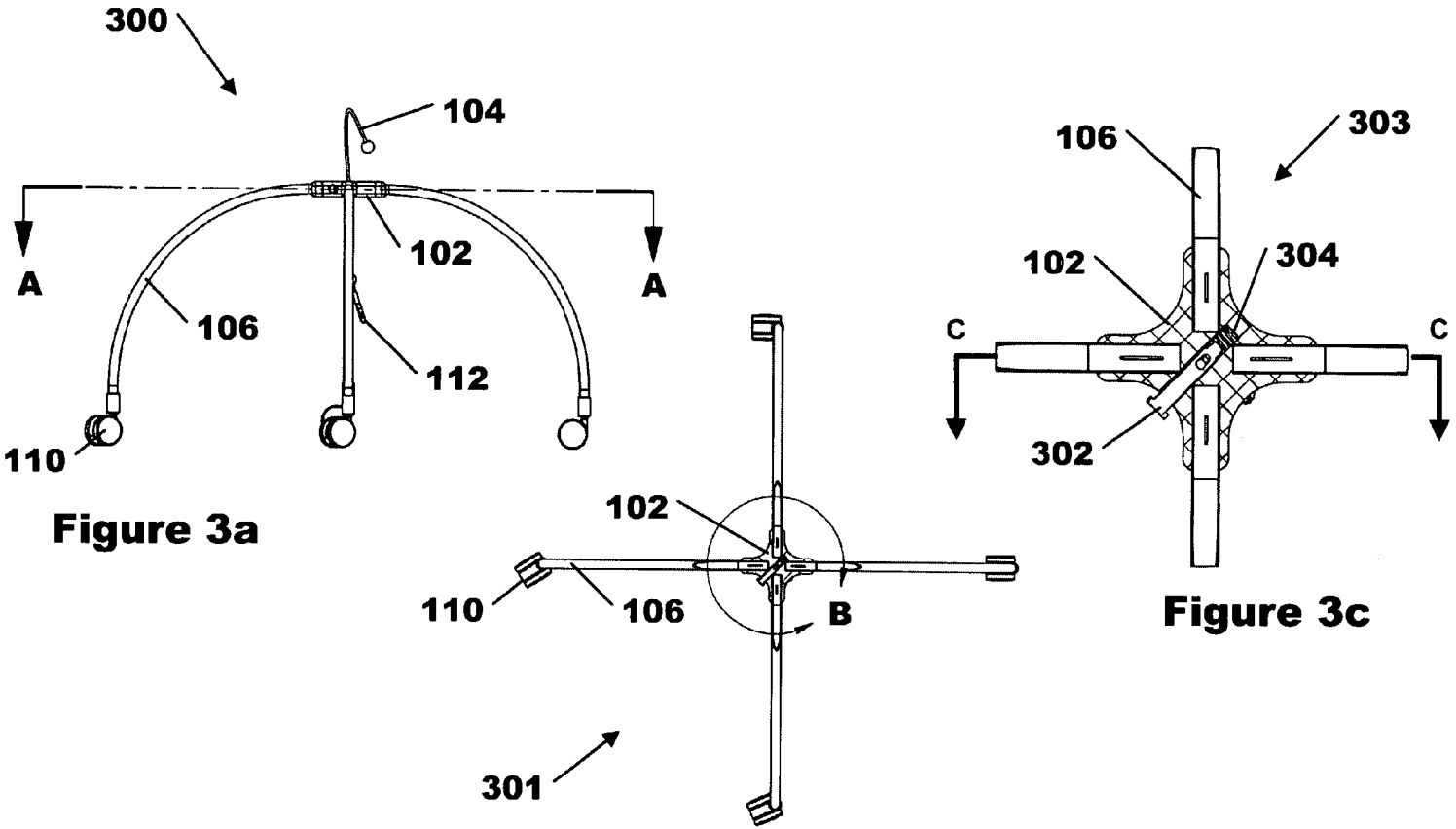
FIG. 3*a* is a side view of a mobility device, in accordance with an example embodiment of the present invention.
FIG. 3*b* is a partial cross section view through section A-A of FIG. 3*a*, in accordance with an example embodiment of the present invention.
FIG. 3*c* is a magnified view of detail B of FIG. 3*b*, in accordance with an example embodiment of the present invention.

FIG. 3*a* is a side view 300 of a mobility device 100 without harness 114, in accordance with an example embodiment of the present invention. FIG. 3*b* is a partial cross section view 301 through section A-A of FIG. 3*a*. FIG. 3*c* is a magnified view 303 of detail B of FIG. 3*b*. The magnified view 303 illustrates detail of locking device 302 which, in concert with spring 304, serves to lock support cable 104 (not shown) in place relative to hub 102. When the locking device 302 is pushed in (toward the center of hub 102), compressing spring 304, the tension holding support cable 104 (not shown) is relaxed, allowing support cable 104 free travel through the hub 102.

Figure 4:
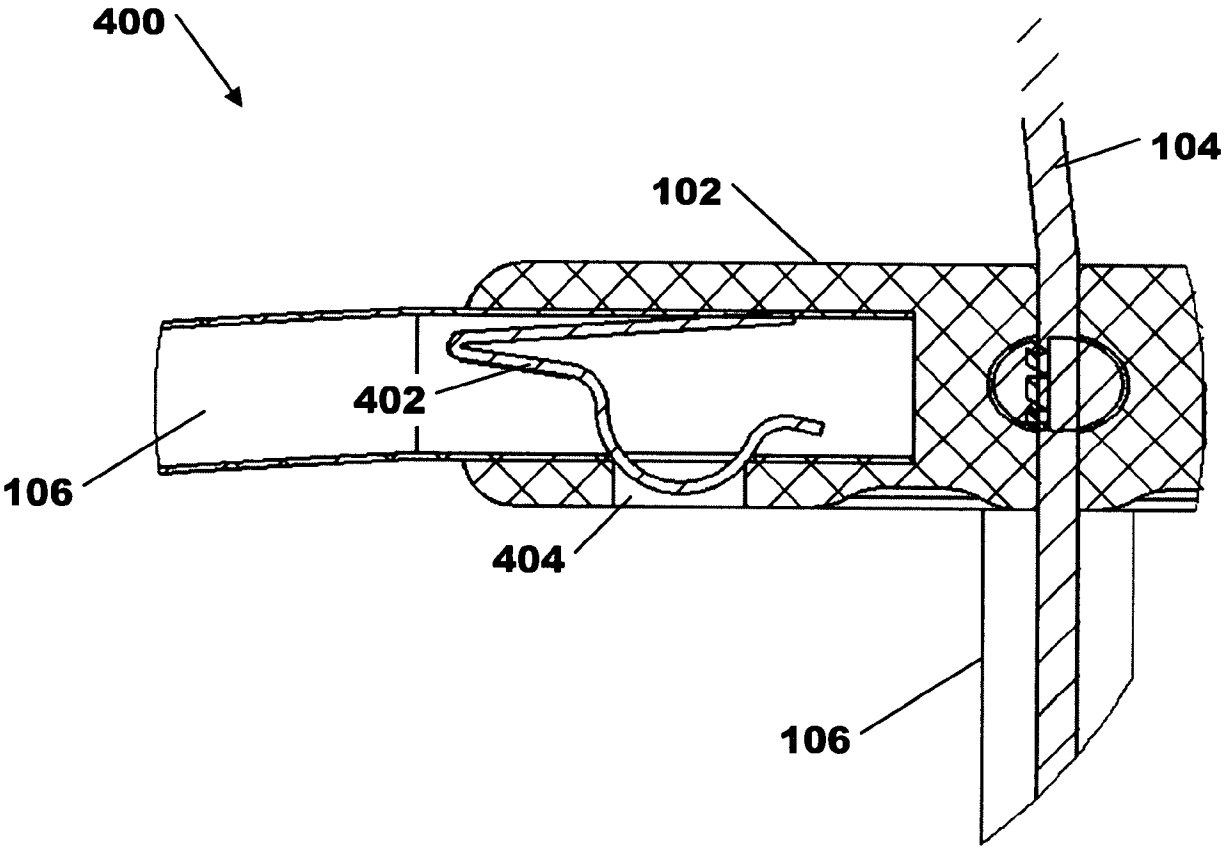
FIG. 4 is a partial cross section view through section C-C of FIG. 3*c*, in accordance with an example embodiment of the present invention.

FIG. 4 is a partial cross section view 400 through section C-C of FIG. 3*c*, in accordance with an example embodiment of the present invention. View 400 illustrates the method by which leg(s) 106 are locked into hub 102. Leg(s) 106 are inserted into cavities within hub (see FIG. 5). A narrow slot 404 aligns with a similar slot (shown but not referenced) in leg 106. Locking spring clip 402 engages with slot 404, through the matching slot in leg 106, to fix leg 106 to hub 102.

Figure 5A:
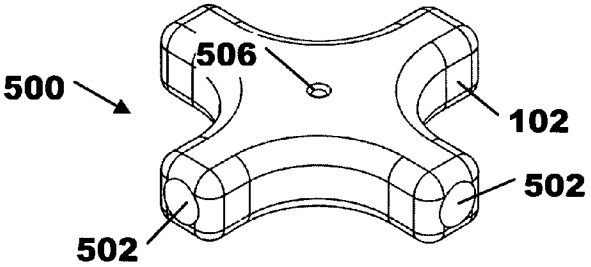
FIG. 5*a* is a perspective view of hub 102, in accordance with an example embodiment of the present invention.
Figure 5D:
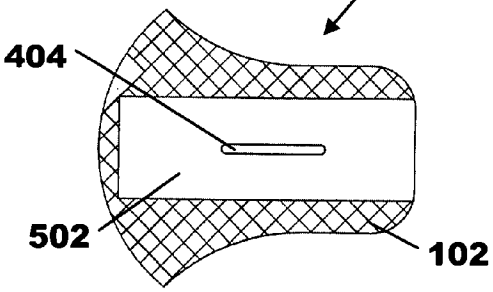
FIG. 5*d* is a magnified view of detail 505 of FIG. 5*c*, in accordance with an example embodiment of the present invention.
Figure 5B:
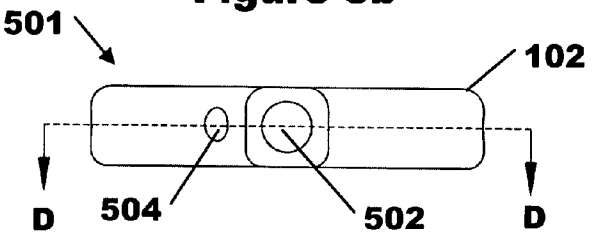
FIG. 5*b* is a side view of hub 102, in accordance with an example embodiment of the present invention.
Figure 5C:
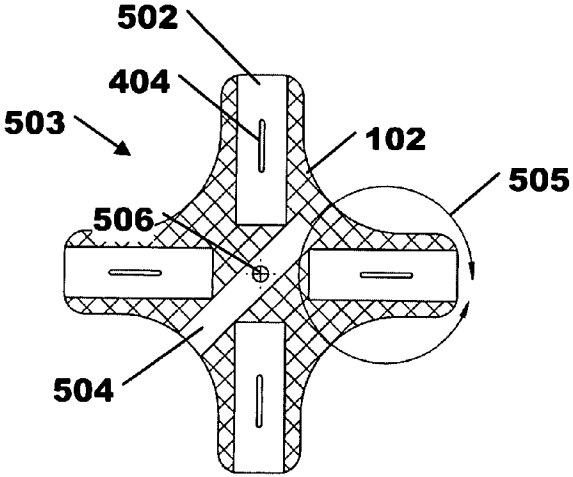
FIG. 5*c* is a cross section view through section D-D of FIG. 5*b*, in accordance with an example embodiment of the present invention.

FIG. 5*a* is a perspective view 500 of hub 102, in accordance with an example embodiment of the present invention. Legs 106 (not shown) are inserted into cavities 502. A port 506 extending from top to bottom of hub 102 is provided for support cable 104 (not shown). FIG. 5*b* is a side view 501 of hub 102. Cavity 504 is provided for locking device 302. FIG. 5*c* is a cross section view 503 through section D-D of FIG. 5*b*. This view 503 shows the intersection of cavity 504 with port 506, which allows support cable 104 (not shown) to pass through a portion of locking device 302 (not shown). FIG. 5*d* is a magnified view of detail 505 of FIG. 5*c*, in accordance with an example embodiment of the present invention. The view 505$^{e}$ shows slot 404 situated within cavity 502.

Figure 6A:
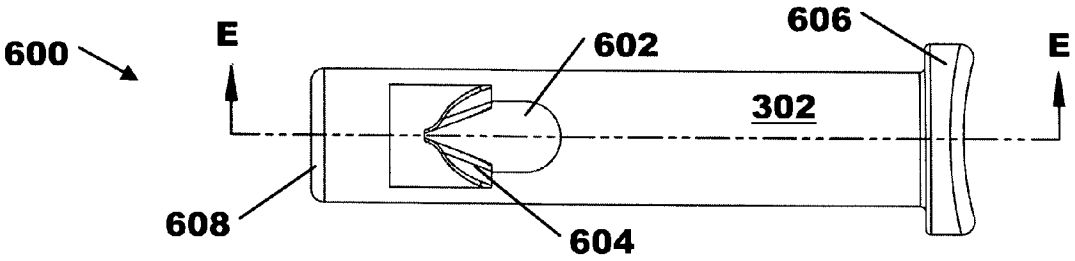
FIG. 6*a* is a top view of cable locking device 302, in accordance with an example embodiment of the present invention.
Figure 6B:
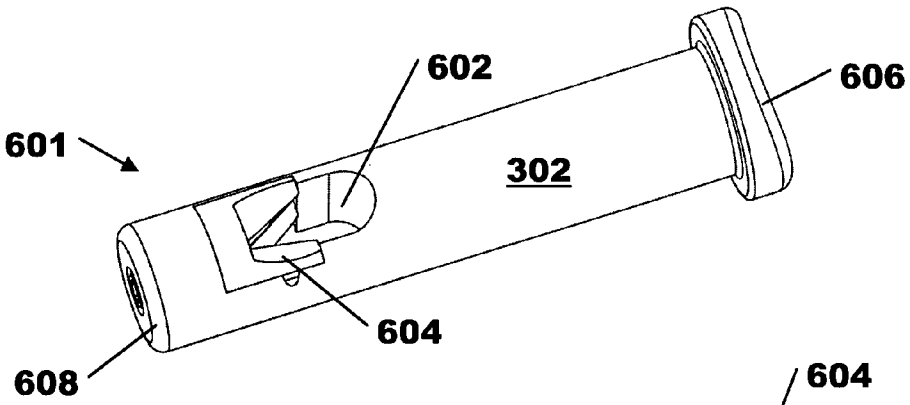
FIG. 6*b* is a perspective view of cable locking device 302, in accordance with an example embodiment of the present invention.
Figure 6C:
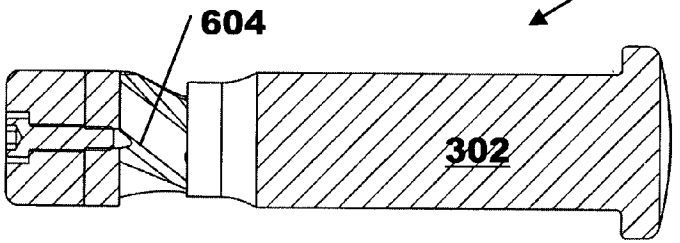
FIG. 6*c* is a cross section view of cable locking device 302, in accordance with an example embodiment of the present invention.

FIGS. 6*a-c* show various views of cable locking device 302. FIG. 6*a* is a top view 600 of cable locking device 302.

FIG. 6*b* is a perspective view 601 of cable locking device 302. FIG. 6*c* is a cross section view 603 of cable locking device 302, all views in accordance with example embodiments of the present invention. Referring to FIGS. 6*a* and 6*b*, cable locking device 302 has a port (or cut out) 602 through which cable 104 is drawn. When locking device 302 is mounted within port 504 in hub 102 (see FIG. 3*c*), support cable 104 is drawn through cavity 506, which is aligned with port 602 of the locking device 302. A device 604 having a plurality of protruding sharp edges, engages with the side of support cable (not shown) as the cable 104 is pinched against the walls of cavity 506 under tension of spring 304 (see FIG. 3*c*), holding support cable 104 tightly in place. Spring 304 bears on end surface 608 of locking device 302. To loosen support cable 104, pressure is placed on flange 606 of locking device 302, easing the contact of the sharp edges of device 604 with support cable 104 and allowing the support cable to be freely drawn through the hub 102. This locking mechanism allows vertical adjustment of support cable 104 under load of the weight of a patient within the harness 114, as in FIG. 2.

Figure 7:
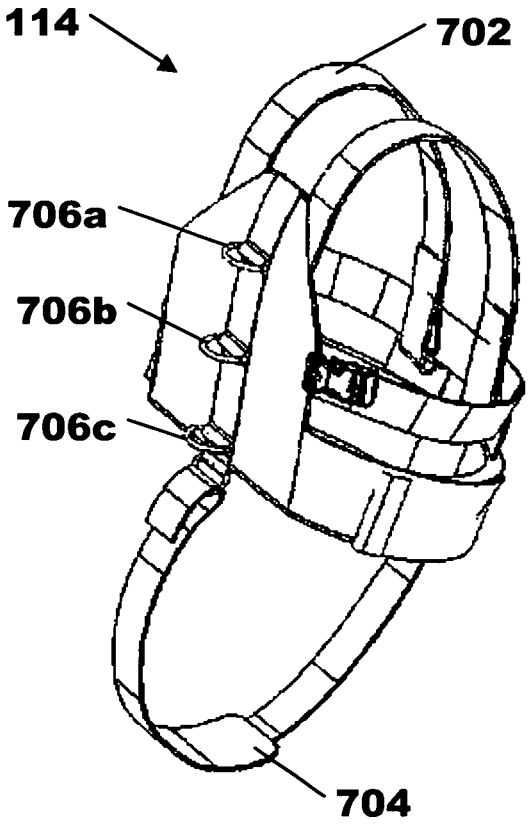
FIG. 7 is a perspective view of harness 114, in accordance with an example embodiment of the present invention.

FIG. 7 is a perspective view 700 of harness 114, in accordance with an example embodiment of the present invention. Harness 114 is comprised of two main sections. An upper section 702 and a lower section 704. Along the back of the upper section 702 are mounted a plurality of "D" rings, which are used to support the patient via support cable 104 and carabineer 112 (see FIG. 2).

Figure 8A:
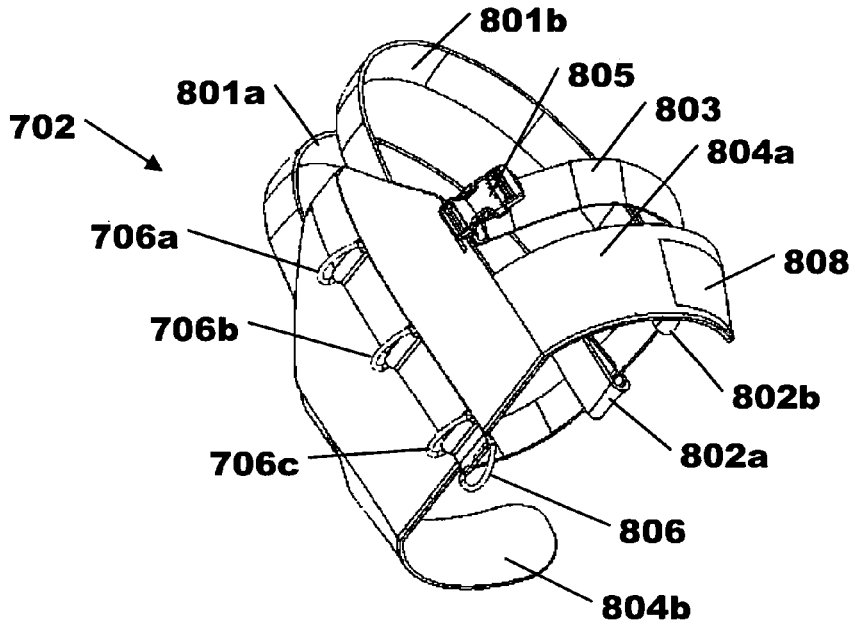
FIG. 8*a* is a perspective view of an upper portion of harness 114, in accordance with an example embodiment of the present invention.

FIG. 8*a* is a perspective view of an upper section 702 of harness 114. Upper section 702 comprises shoulder straps 801*a,b*, waist band 804*a,b*, chest band 803, and "D" rings 706*a-c*. Shoulder straps 801*a,b* are terminated in loops 802*a,b*, which couple with slotted tabs (see 810*a,b* FIG. 8*b*) on the lower section 704. Chest band 803 also passes through loops 802*a,b* before being terminated by buckle 805. A hook and loop fastener 808 is attached to the outer surface of waste bands 804*a,b* for coupling with a mating hook and loop fastener (see 814 FIG. 8*b*) of the lower section 704. "D" ring 806 mates with the crotch strap (see 818 FIG. 8*b*) on the lower section 704 of harness 114.

Figure 8B:
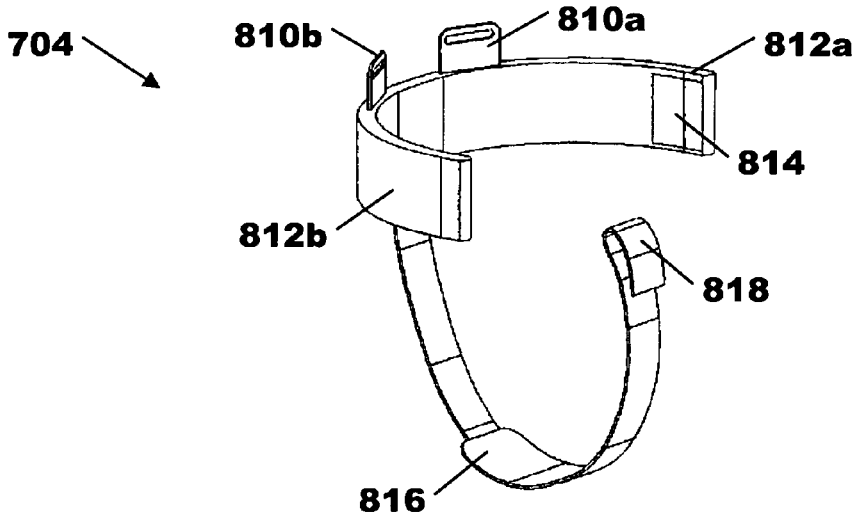
FIG. 8*b* is a perspective view of a lower portion of harness 114, in accordance with an example embodiment of the present invention.

FIG. 8*b* is a perspective view of a lower section 704 of harness 114, in accordance with an example embodiment of the present invention. Lower section 704 comprises a waist band 812*a,b* and crotch strap 816. Slotted tabs 810*a,b* engage with loops 802*a,b* on shoulder straps 801*a,b* of the upper section 702. Crotch strap 816 is terminated with loop 818, which mates with "D" ring 806 mounted on the upper section 702. Mating hook and loop fasteners 814 couple with hook and loop fasteners 808 on the waist bands 804*a,b*.

Figure 9A:
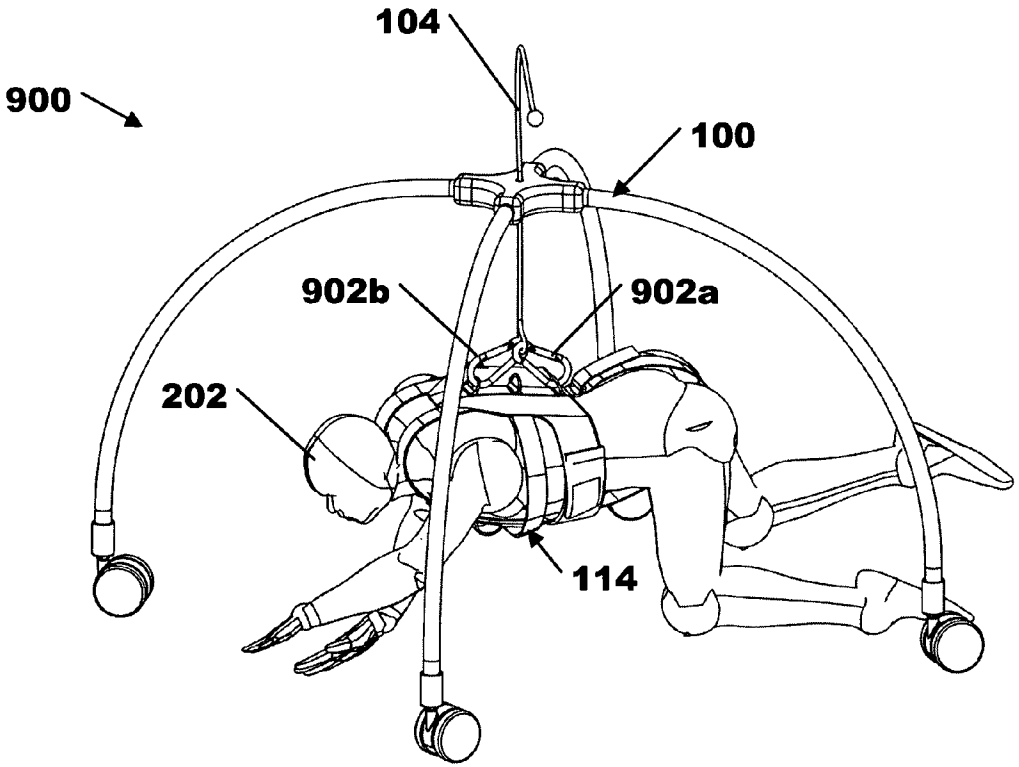
FIG. 9*a* is a perspective view of mobility device 100, in accordance with another example embodiment of the present invention.

FIG. 9*a* is a perspective view 900 of mobility device 100, in accordance with yet another example embodiment of the present invention. In the example embodiments heretofore described, a single carabineer 112 couples the support cable 104 to a single "D" ring 706 on harness 114. In order to shift the balance point of a patient in these embodiments, the load (i.e. patient's weight) must be removed (or supported from underneath) as the carabineer is decoupled from one "D" ring and advanced to the next. This can be quite inconvenient for personnel charged with making adjustments. In the example embodiments of FIGS. 9*a-g*, two carabineer clips 902*a,b* are provided, which allow balance point adjustments while the mobility device is under load. When making the adjustment, one carabineer is always connected to support the weight of the patient, as shall be illustrated below.

Figure 9C:
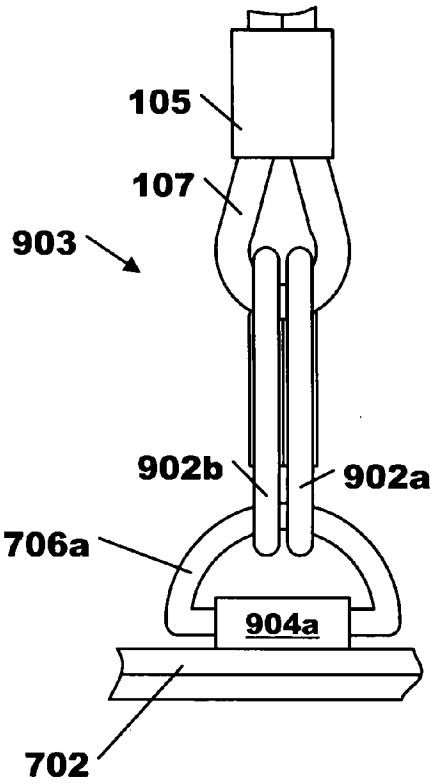
FIG. 9*c* is a partial end view of the harness support for the mobility device illustrated in FIG. 9*a*, in accordance with another example embodiment of the present invention.
Figure 9B:
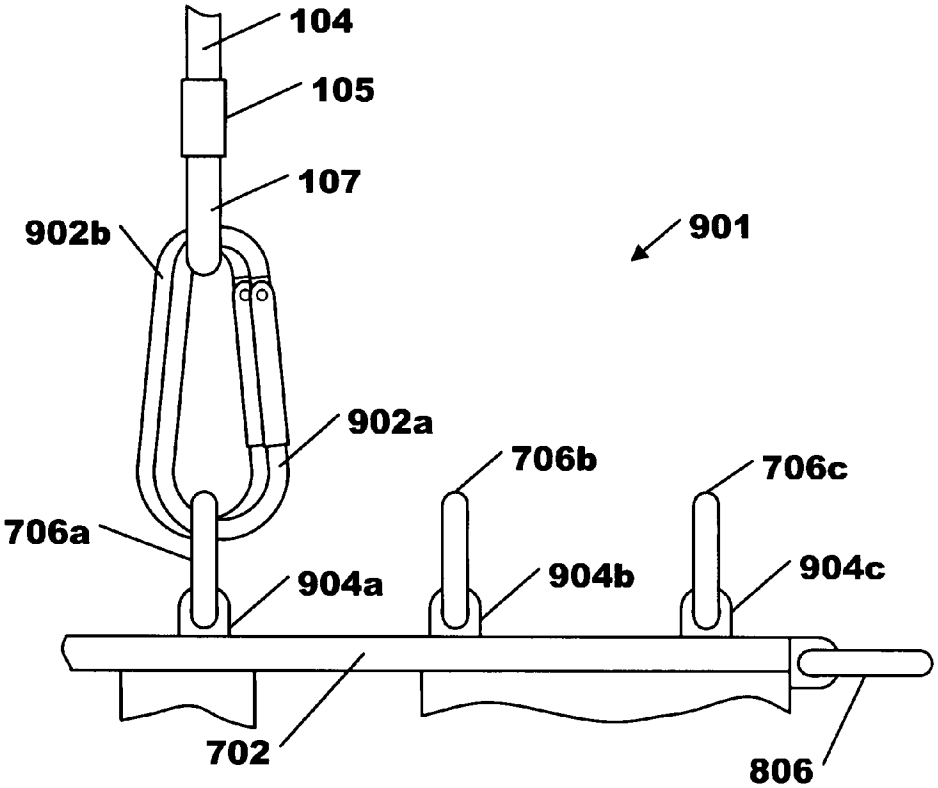
FIG. 9*b* is a partial side view of the harness support for the mobility device illustrated in FIG. 9*a*, in accordance with another example embodiment of the present invention.

FIG. 9*b* is a partial side view 901 of the harness support for the mobility device illustrated in FIG. 9*a*, in accordance with another example embodiment of the present invention. "D" rings 706*a-c* are attached to the upper harness section 702 via bosses 904*a-c*. Two carabineer clips 902*a,b* are passed through a loop 107 on the end of support cable 104 which is held in place via ferrule 105. As can be appreciated by those skilled in the art, there are numerous methods to provide a loop at the end of support cable 104, the illustrated example being only one of such methods and is not meant to be limiting. The figure illustrates a starting balance point at "D" ring 706*a*. FIG. 9*c* is a partial end view 903 of the harness support for the mobility device illustrated in FIGS. 9*a,b*.

Figure 9D:
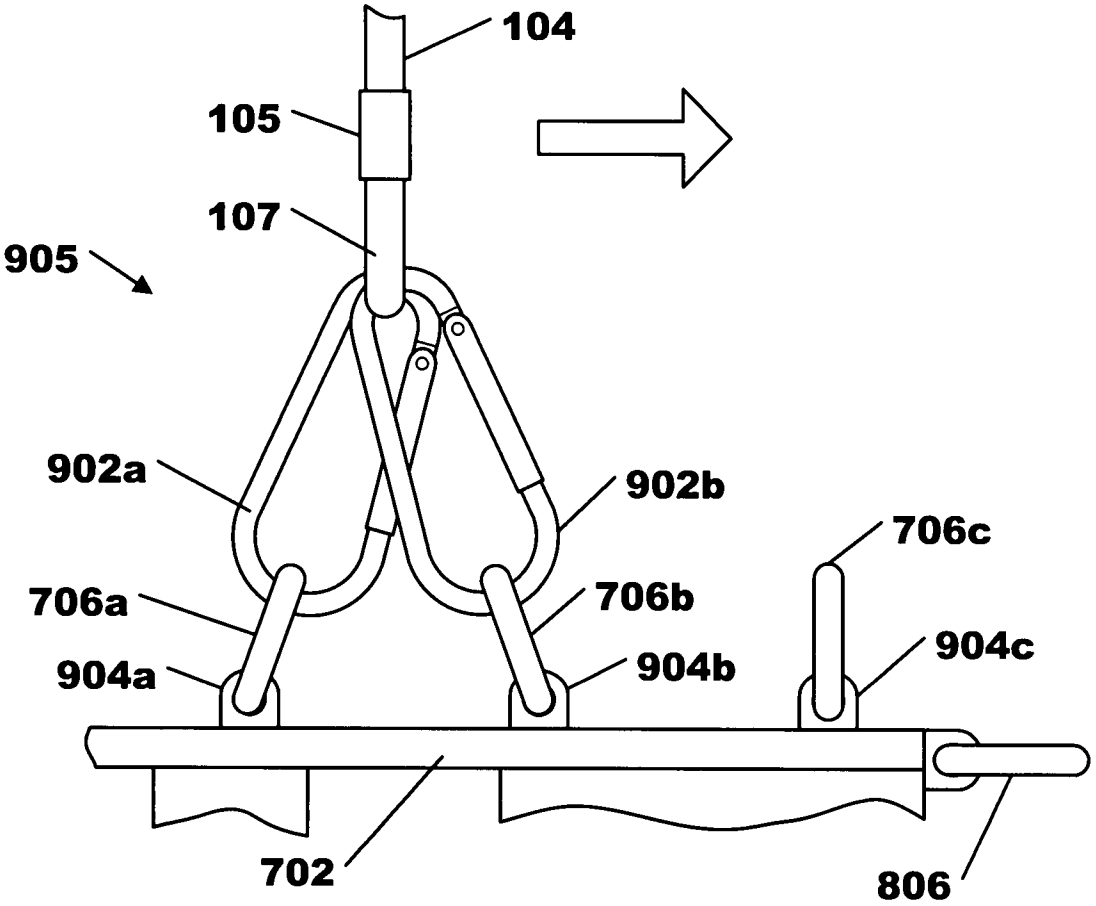
FIGS. 9*d-g* are partial side views illustrating a method of shifting the balance point under tension using two carabineers and the "D" rings on the harness, in accordance with another example embodiment of the present invention.
Figure 9E:
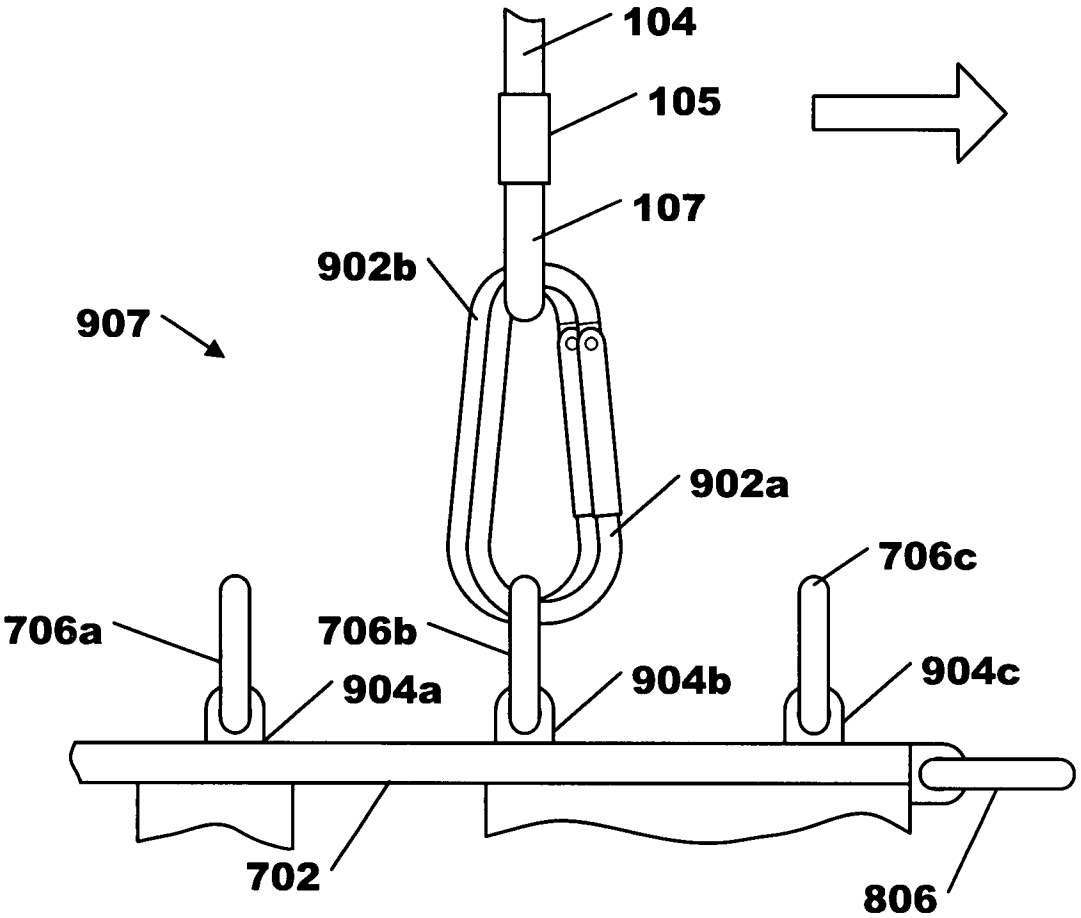
Figure 9F:
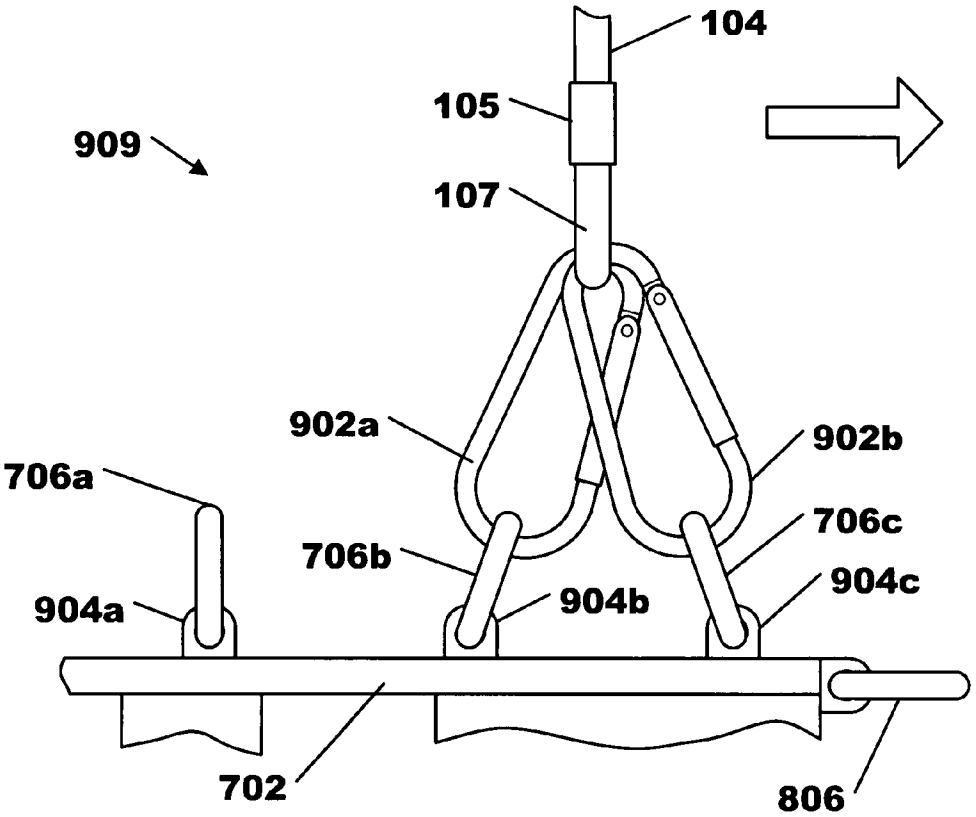
Figure 9G:
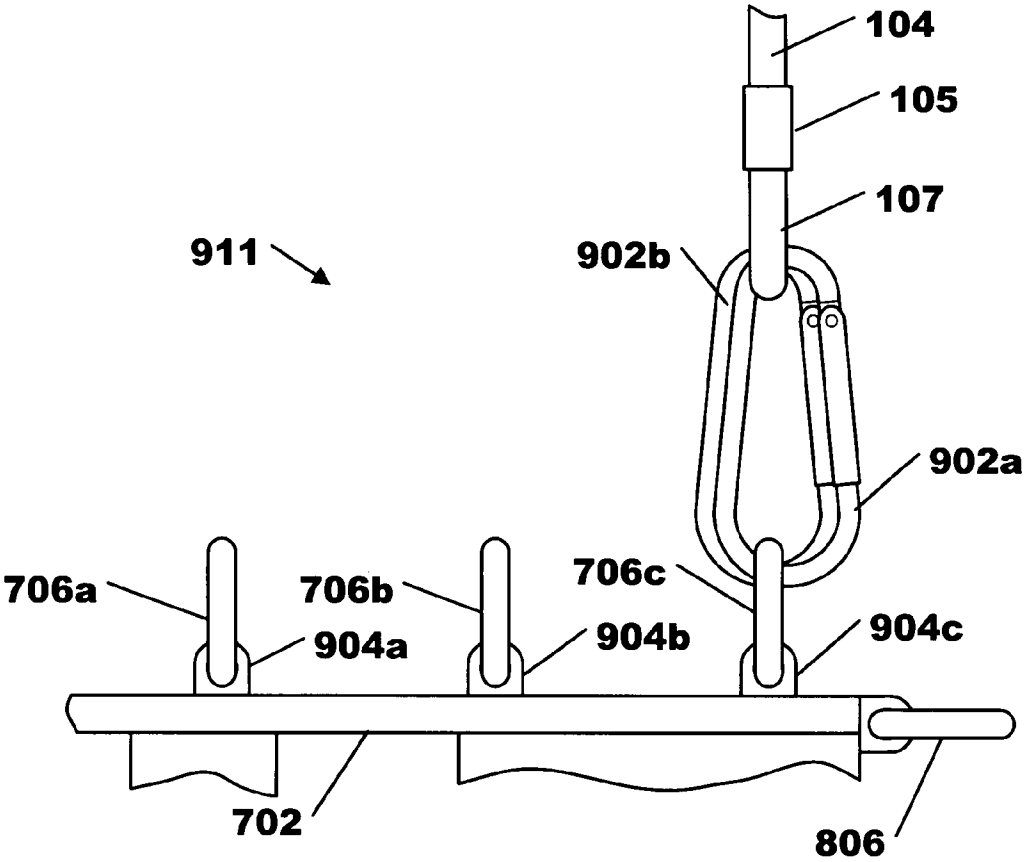

FIGS. 9*d-g* are partial side views 905, 907, 909, 911 illustrating a method of shifting the balance point rearward, under tension, using two carabineers and the "D" rings on the harness, in accordance with another example embodiment of the present invention. FIG. 9*b* starts with the balance point over "D" ring 706*a*. In FIG. 9*d* the balance point is shifted to a point between "D" rings 706*a* and 706*b* by unlatching carabineer 902*b* from "D" ring 706*a* and re-attaching it to "D" ring 706*b*. Carabineer 902*a* is left coupled to "D" ring 706*a*. In FIG. 9*e* the balance point is shifted further right to a point over "D" ring 706*b* by unlatching carabineer 902*b* from "D" ring 706*a* and re-attaching it to "D" ring 706*b*. In FIG. 9*f* the balance point is shifted to a point between "D" rings 706*b* and 706*c* by unlatching carabineer 902*b* from "D" ring 706*b* and re-attaching it to "D" ring 706*c*. In FIG. 9*g* the balance point is shifted further right to a point over "D" ring 706*c* by unlatching carabineer 902*b* from "D" ring 706*b* and re-attaching it to "D" ring 706*c*.

Although various embodiments have been described using specific terms and devices, such description is for illustrative purposes only. The words used are words of description rather than of limitation. It is to be understood that changes and variations may be made by those of ordinary skill in the art without departing from the spirit or the scope of various inventions supported by the written disclosure and the drawings. In addition, it should be understood that aspects of various other embodiments may be interchanged either in whole or in part. It is therefore intended that the claims be interpreted in accordance with the true spirit and scope of the invention without limitation or estoppel.

What is claimed is:

1. A system for aiding the crawling mobility of a human or animal occupant by providing a lifting force for the occupant while the occupant is crawling over a surface, comprising:

a first support leg having a first end and a second end, said second end having a first caster attached thereto;

a second support leg having a first end and a second end, said second end having a second caster attached thereto;

a third support leg having a first end and a second end, said second end having a third caster attached thereto;

a fourth support leg having a first end and a second end, said second end having a fourth caster attached thereto;

a hub, said hub having a first cavity, a second cavity, a third cavity, and a fourth cavity fashioned therein, said first end of said first support leg being inserted within said first cavity of said hub, said first end of said second support leg being inserted within said second cavity of said hub, said first end of said third support leg being inserted within said third cavity of said hub, said first end of said fourth support leg being inserted within said fourth cavity of said hub, said first through said fourth support legs being oriented with respect to said hub in a manner such that said first through said fourth casters are in contact with said surface;

a support cable, said support cable extending through a center of said hub, said support cable having an attachment end portion situated below said hub;

a harness device, said harness device extending around at least a portion of the occupant, said harness device having a plurality of attachment devices mounted thereto, said plurality of attachment devices aligned in a linear array along a spine of said occupant;

a coupling device, said coupling device operative to connect said attachment end portion of said support cable to one or more of said plurality of attachment devices mounted on said harness device;

a locking device, said locking device operative to fix a position of said support cable relative to said hub, said locking device having a port fashioned therein, said support cable extending through said port fashioned in said locking device, said locking device having serrated edges protruding into said port, operative to engage said support cable when a locking force is applied axially to said locking device, forcing said serrated edges into said support cable, fixing said support cable relative to said hub;

wherein a point of attachment of said coupling device to one or more plurality of attachment devices within said linear array along said spine of said occupant alters a balance point of said lifting force, while said support cable is under tension and while said support cable is free of tension.

2. The system as recited in claim 1, wherein said locking force applied axially to said locking device is applied by a spring.

3. The system as recited in claim 1, wherein said first support leg, said second support leg, said third support leg, and said fourth support leg are non-rotatably attached to said hub.

4. The system as recited in claim 1, wherein said coupling device is a pair of carabineers.

5. The system as recited in claim 1, wherein said coupling device is a single carabineer.

6. The system as recited in claim 1, wherein said plurality of attachment devices mounted to said harness device are "D" rings.

7. The system as recited in claim 6, wherein said harness device comprises an upper section and a lower section.

8. The system as recited in claim 7, wherein said "D" rings are attached to said upper section.

* * * * *